United States Patent [19]

Backman et al.

[11] Patent Number: 4,586,316

[45] **Date of Patent: * May 6, 1986**

[54] METHOD AND APPARATUS FOR FORMING PACKS OF ARTICLES

[75] Inventors: Erik E. Backman, Gothenburg; Ulf A. Henrekson, Kungalv; Inge L. Nertman, Kungälv, all of Sweden

[73] Assignee: Aktiebolaget Volvo, Sweden

[ * ] Notice: The portion of the term of this patent subsequent to Mar. 16, 1999 has been disclaimed.

[21] Appl. No.: 354,954

[22] Filed: Mar. 5, 1982

Related U.S. Application Data

[62] Division of Ser. No. 55,428, Jul. 6, 1979, Pat. No. 4,319,684.

[30] Foreign Application Priority Data

Jul. 7, 1978 [SE] Sweden ..... 7807628

[51] Int. Cl.[4] ..... B65B 11/58

[52] U.S. Cl. ..... 53/449; 53/467; 53/453

[58] Field of Search ..... 53/427, 453, 467, 219, 53/449, 218; 206/461–465, 467, 470

[56] References Cited

U.S. PATENT DOCUMENTS

| | | | |
|---|---|---|---|
| 2,502,738 | 4/1950 | Nicolle | 53/218 |
| 2,530,306 | 11/1950 | Land | 53/453 |
| 3,228,168 | 1/1966 | Grindrod et al. | 53/427 |
| 3,354,605 | 11/1967 | Amberg et al. | 53/453 X |
| 3,400,811 | 9/1968 | Panicci | 53/453 X |
| 3,442,064 | 5/1969 | Conti | 53/219 X |
| 3,481,100 | 12/1969 | Bergstrom | 53/453 X |
| 3,657,857 | 3/1972 | De Woskin et al. | 53/453 |
| 3,972,155 | 8/1976 | Mahaffy et al. | 53/427 X |
| 4,047,358 | 9/1977 | Heffernan et al. | 53/453 |
| 4,184,308 | 1/1980 | Sharp | 53/453 X |
| 4,319,684 | 3/1982 | Backman et al. | 53/396 X |

*Primary Examiner*—John Sipos
*Assistant Examiner*—Steven P. Weihrouch
*Attorney, Agent, or Firm*—Steele, Gould & Fried

[57] ABSTRACT

A package comprises an elongate member having a connected row of article receptacle parts and receptacle enclosing parts. The length of each elongate member is a multiple of the width of a finished pack equal to the number of receptacle parts. Each elongate member is positioned for filling with articles with the opening of the receptacle parts facing upwards and each member is filled with articles simultaneously, or in one operation. The elongate member is closed in one operation for all receptacle parts by folding over the connected row of closing parts to a position covering the openings of the receptacle parts. Each elongate member is finally divided into separate packs by separating the elongate member along predetermined locations.

2 Claims, 7 Drawing Figures

METHOD AND APPARATUS FOR FORMING PACKS OF ARTICLES

CROSS-REFERENCE TO RELATED APPLICATION

This application is a division of co-pending application Ser. No. 055,428, filed July 6, 1979, now U.S. Pat. No. 4,319,684.

BACKGROUND OF THE INVENTION

1. Field of the Invention

The present invention relates to a method and apparatus for forming packs of articles.

2. Prior Art

When manufacturing the packages for such packs and filling them with articles, each package has, up to now, been handled separately and finished before it is filled with the articles. This often involves difficulties with handling the packages, which are easily displaced, particularly during the filling procedure. This partly depends on the fact that the packages generally are of very low weight and often of lower weight than the articles they are to carry. Further, the capacity of each machine for filling is relatively low.

SUMMARY OF THE INVENTION

The object of the present invention is to develop a method for packing articles in a more efficacious manner.

There is provided by the present invention a method of forming packs of articles, comprising the steps of: forming an elongate member having article-receptacle parts and receptacle-closing parts, in the form of a connected plurality of receptacle parts and closing parts, with the length for each elongate member being a multiple of the width of a finished packing; positioning each elongate member for the purpose of filling it with articles, with the opening of the receptacle's parts facing upwards, filling all the receptacle's parts of an elongate member with articles in one operation; closing in one operation all receptacle parts by positioning the connected closing parts of the elongate member over the openings of the receptacle parts; and thereafter, dividing each elongate member into separate packs by separating the elongate member along predetermined locations. The plurality of receptacle and closing parts are preferably arranged to form a row.

The present invention also provides apparatus for forming such packs of articles, comprising: a table with a row of recesses to receive the receptacle parts of the elongate member with the openings thereof facing upwards in a position for filling with articles; connecting means displaceable between a first position above the table and a second position in contact with the table and arranged to contact the closing parts of an elongate member in the first position and to fold them over the receptacle parts by movement to the second position; and, separating means to separate the elongate member into separate packs.

BRIEF DESCRIPTION OF THE DRAWINGS

The present invention will now be further described, by way of example, with reference to the accompanying drawings, in which.

DETAILED DESCRIPTION OF THE PREFERRED EMBODIMENTS

Figure 1:
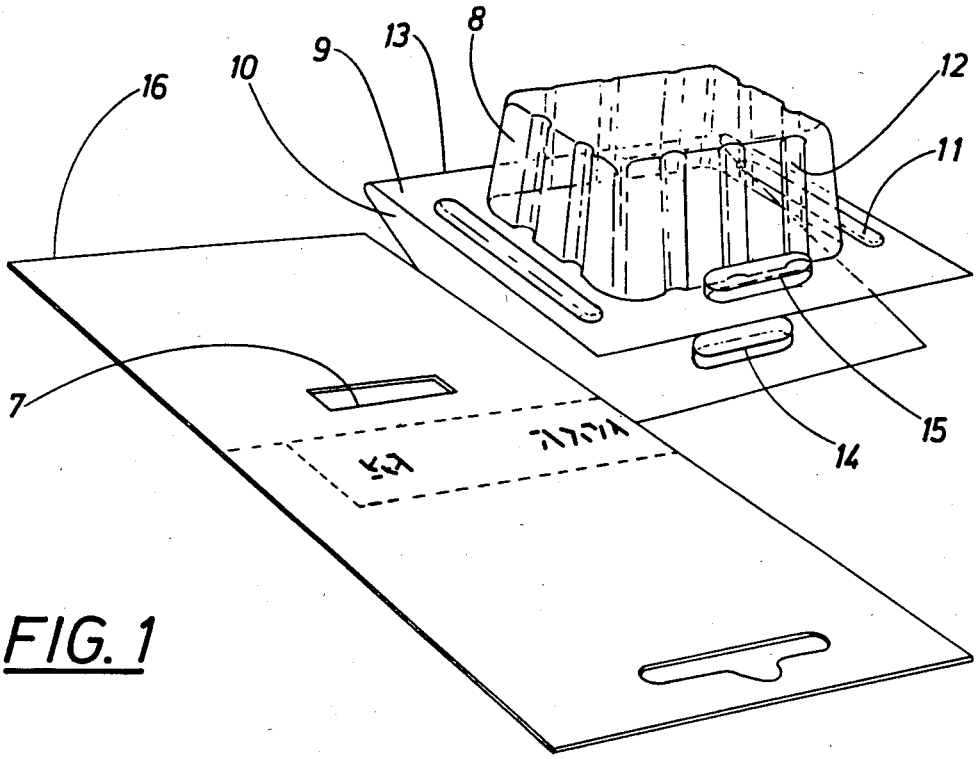
FIG. 1 is a perspective view of two parts of a package employed in an embodiment of the invention.
Figure 2:
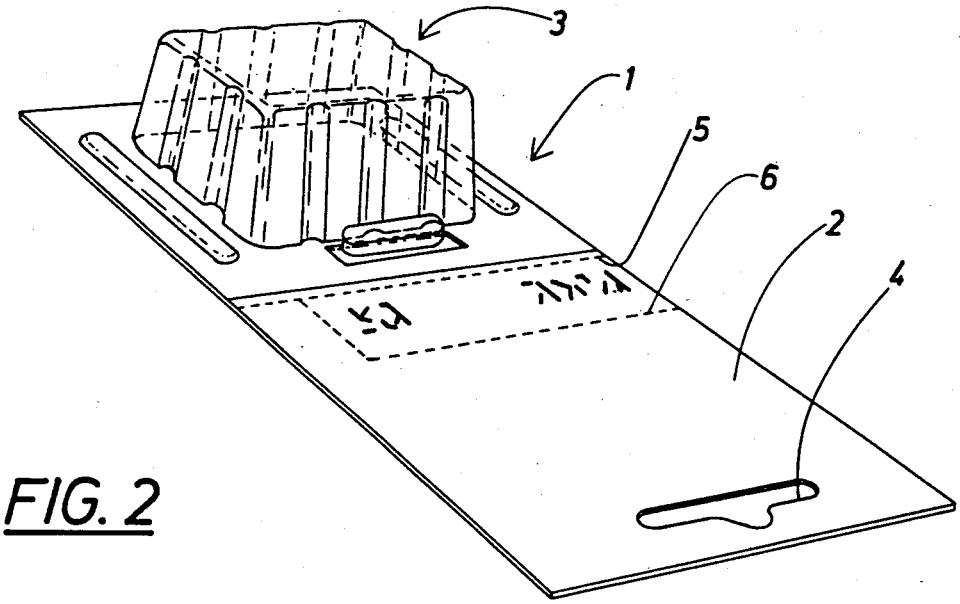
FIG. 2 shows the finished pack in a perspective view, the articles being omitted for clarity.

As shown in FIG. 2, a blister pack 1 is formed by a piece of cardboard 2, to which a transparent plastic part 3 is fastened, which forms a transparent receptacle or container, into which one or several articles (not shown) are inserted. The piece of cardboard 2 can provide information and it is formed with a hole 4 for suspending the pack in, for example, storage or sales racks. The cardboard 2 is provided with a perforation rule 5 located very close to the extreme end of the plastic part 3 and with a perforation rule 6 having an angular bend, by means of which perforations the outer portion of the cardboard can be torn off from the portion, which is in the front of the plastic part 3, and at the same time a small part can be detached, viz., the portion between the perforation rules 5 and 6. This part can in this connection form a label. As is moreover evident from FIG. 1, the cardboard 2 is in addition formed with a through opening 7 located within the area of the plastic part 3.

The plastic part 3 can be seen more exactly in FIG. 1, which shows the cardboard 2 and the plastic part 3 in separated condition. One portion of plastic part 3 is formed with a container portion 8 and a rim flange 9. The other is a bottom portion 10, forming a flap which can be folded inwards against the rim flange 9. The flange 9 and the receptacle 8 are provided with embossed reinforcing reliefs 11 and 12 respectively. The flap and container portion form a fold 13. The free edge of the flap opposite the fold, carries an embossed portion projecting out from the flange 9, referred to hereinafter as the male part. The rim flange carries an embossed portion projecting away from the bottom portion, referred to hereinafter as the female part 15. The male part 14 and the female part 15 are located in relation to each other to form a snap-in lock, which will be described later.

In the assembled condition of the packing, which is shown in FIG. 2, the edge of the cardboard 2 is pushed up against the hinge fold 13, and the flange 9 of the plastic part 3 and the flap 10 are connected with each other by means of the snap-in lock formed by the male part 14 and the female part 15, whereby the male part 14 penetrates through the opening of the cardboard 2. The cardboard is thereby locked in a predetermined position to the plastic part 3. The snap-in lock 14,15 is held together with such a force that the packing is kept closed in a secure manner, but in such a manner that it can be opened up and relocked in the same secure manner without any damage either to the cardboard or to the plastic part 3.

In the presently preferred embodiment the method of manufacture comprises the following steps:

1. Producing a cardboard blank constituting a multiple of the piece of cardboard 2. The cardboard blank is designated with 17 in FIG. 3. The cardboard blank has two free edges 18 and 19 respectively, the edge 18 of the finished piece of cardboard being intended to form the edge 16 (FIG. 1) and the edge 19 being intended to form the edge opposing the edge 16. The cardboard blank 17 shall have the same width as the distance from the edge 16 to the opposing edge of the piece of cardboard 2, whereas the length is a multiple of the width of the piece of cardboard 2.

2. Providing the cardboard blank 17 with the desired printing, which is repeated as many times as the number of cardboard pieces 2 contained in the blank. In a corresponding manner the cardboard blank is provided with openings corresponding to the openings 4 and 7 of the finished piece of cardboard 2 and perforation rules corresponding to the perforation rules 5 and 6.

Figure 3:
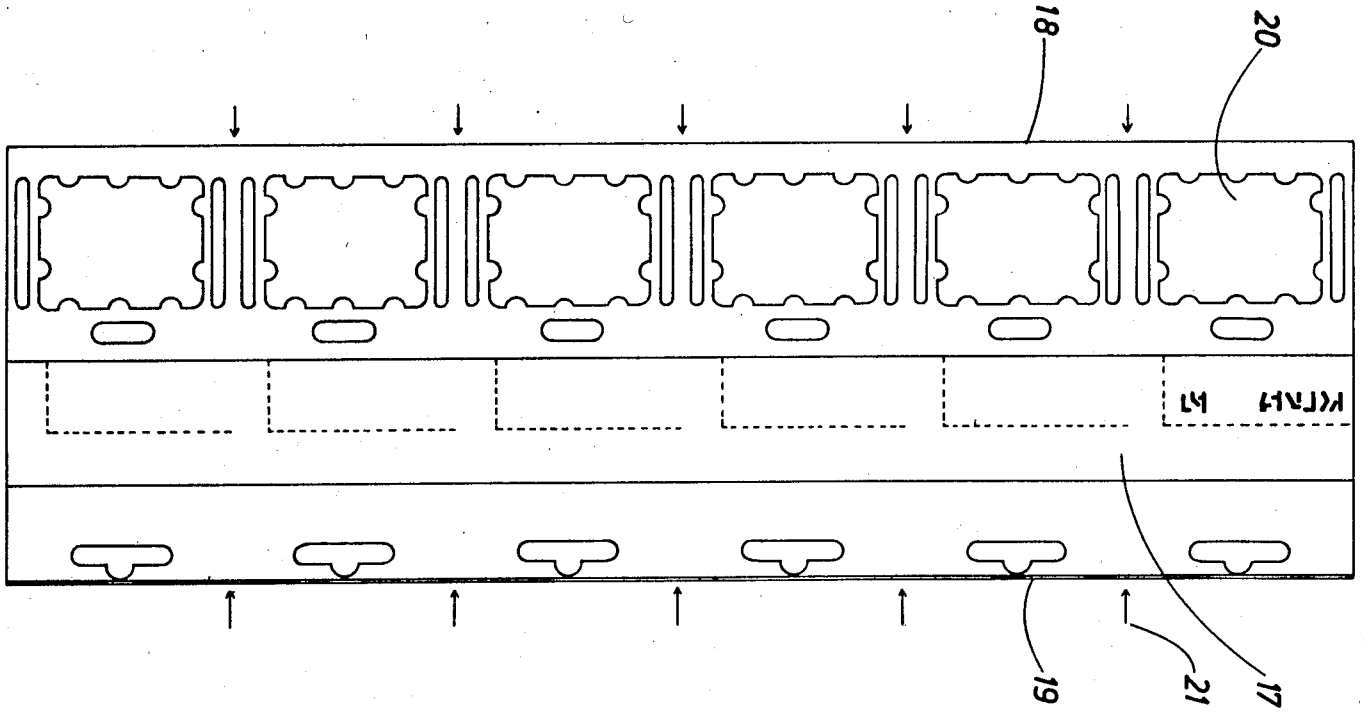
FIG. 3 is a view of the pack in a stage of its formation.

3. Preparing a plastic blank, which in FIG. 3 is designated 20. As was the case with the cardboard blank 17, the plastic blank 20 forms an uninterrupted row of the finished detail, viz. the plastic part 3, the details of which are repeated in the number of plastic parts which can be contained in the blank 20. Both the blanks 17 and 20 are of equal length. The plastic blank 20 can be made from a plastic sheet employing vacuum forming or hot die-pressing techniques, but it is also possible to use the injection moulding process. The plastic blank is provided with a fold corresponding to the fold 13 of the finished plastic part or a fractural kerf in the form of a perforation for the same purpose.

4. Inserting the plastic blank 20, in the open condition, into a packing and locking apparatus. Those portions of the blank which in the finished plastic part constitute the flap 10, and the remaining portion of the rim flange are folded away from each other, with the portions of the blank which form the containers 8 having their interiors facing upwards.

5. Filling the receptacle portions of the blank with the articles intended to be packed.

6. Inserting the cardboard blank with the edge 18 facing the fold or fractural kerf of the plastic blank and centered relative to the plastic blank.

7. Closing the plastic blank by folding said portions, which in the finished pack form the flap 10 and said remaining rim flange portion, against each other with the cardboard blank located therebetween, and by means of the apparatus inserting the row of male parts 14 in the row of corresponding female parts 15. The plastic blank 20 is locked on top of the cardboard blank 17 and is fastened to the same because the male parts 14 are located in the corresponding openings 7 of the cardboard blank.

8. Removing the sealed packing blank comprising the cardboard and plastic blank and inserting the packing blank in an apparatus, by means of which the blank is divided up in individual packings. This takes place by cuts at a distance corresponding to the width of the finished packing, whereby a number of finished packings are obtained from the blank, such packings being shown in FIG. 2.

In the finished closed packing blank illustrated in FIG. 3 a length corresponding to six finished packings has been chosen. The blank is divided up at the arrows designated 21, whereby six equal finished packings are formed.

As should have been evident from the description of the method of manufacture, the apparatus for carrying out the same comprises two parts viz. the packing and locking apparatus and the cutting apparatus. Equipment for preparing the cardboard and plastic blanks, already known in the art, is also necessary.

Figure 4:
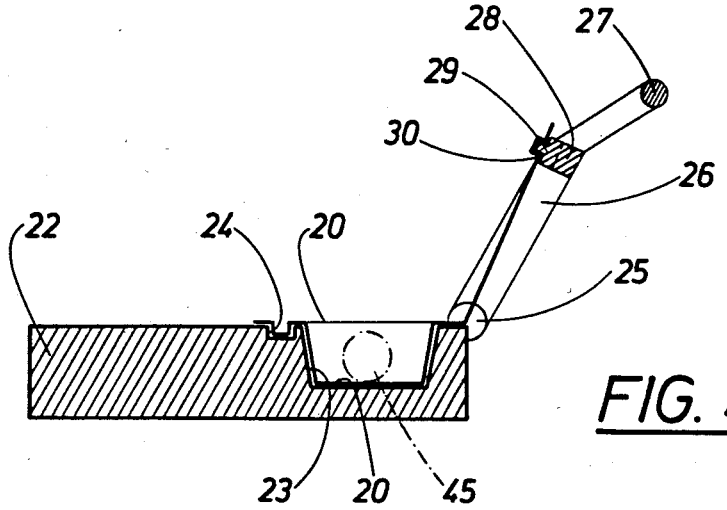
FIGS. 4 to 6 show cross-sectional views of part of the apparatus of the embodiment for forming the pack, as seen in three different working positions illustrating the method; and, FIG. 7 shows an additional part of the apparatus used in producing the pack.
Figure 5:
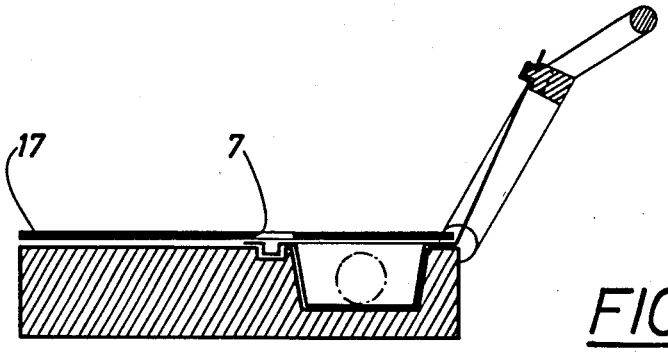
Figure 6:
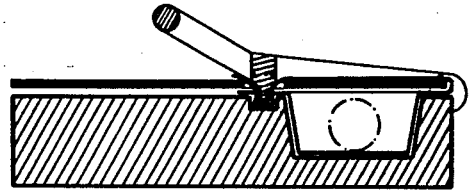

The apparatus for packing and sealing is shown in FIGS. 4–6 in different positions of use. It comprises a base plate 22 with a number of recesses 23, which with correspond in size to the container 8 of the plastic part 3, and the number of which corresponds to the number of containers 8 of the plastic blank 20. There are, moreover, recesses 24 in the plate, which correspond to the female parts 15 of the plastic blank 20. Right in front of each recess 23 there is a recess 24. The recesses 24 have a depth which is slightly less than the height of the female parts 15 above the rim flange 9 of the plastic part 3.

At each one of the ends of the base plate 22 there is a pivot-bearing 25, said pivot-bearings being placed along a common center line, which is approximately in line with the edge 18 of the plastic blank, when the plastic blank is placed in the apparatus. A lever 26 extends from each one of the bearings, said two levers being connected by means of two longitudinal stays, which form a handle 27 placed at the extreme end of the levers 26 and also a pressure bar 28 positioned inside of the handle 27. The pressure bar 28 bears a number of projecting pins 29. The pins 29 are right in front of the recesses 24, and when the levers 26 are lowered down into the position illustrated in FIG. 6 the pins 29 penetrate into the recesses 24. When a plastic blank 20 is inserted into the apparatus in the manner shown in the figures with its receptacles 8 in the recesses 23, then the pins 29 will be inside the male parts 14. The pins 29 are somewhat shorter than the common depth for the male part 14 and the female part 15 and terminate in a dog portion 30.

Figure 7:
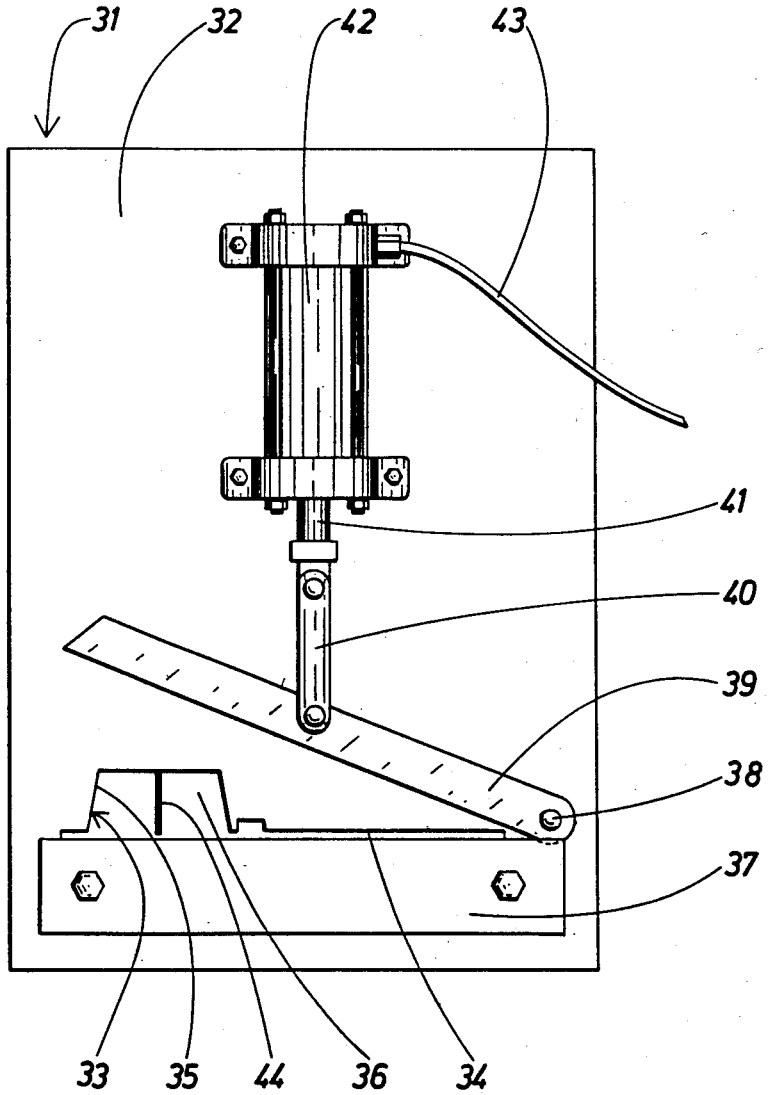

The cutting apparatus as shown in FIG. 7, which forms part of the means according to the invention, comprises a housing 31, which has a plate 32 with an upwards facing surface.

An opening 33 extends through the plate 32, the profile of which opening is adapted to correspond to the profile of the packing illustrated in FIG. 2. Thus, the opening comprises a slit 34 and a projecting part 35 of larger dimension, so that the cardboard 2 of the packing and the plastic part 3 with the container 8 respectively can be let through. The housing continues under the plate and at its bottom terminates in a plate 36, which can be seen though the opening 33.

Along the opening 33 of the plate 32, a knife 37 is mounted in fixed position, and close to this knife another knife 39, which is pivotable, is journalled on a shaft 38. The knives 37 and 39 form a cutting tool, the cutting plane of which is in the same plane as the underside of the knife 37 and the top side of the knife 39. Thus, the knife 39 is mounted at a certain distance above the plate 32. The distance between said cutting plane and the plate 36 is equal to the width of a packing, and accordingly, equal to the distance between two dividing lines 21 (FIG. 3).

By means of a pivotably journalled link 40 the knife 39 is connected with the piston rod 41 of a pneumatic means 42, which is attached to the plate 32. The pneumatic power means 42 is connected with a source of compressed air by means of a hose 43 and a control device.

The control device for the pneumatic power means 42 comprises a release valve (not shown), which is attached to the plate 36, and which is actuated by means of a sensor organ 44 projecting under the opening 35. The control device is arranged in such a manner that each time the sensor organ 44 is pressed down against the plate 36, air is supplied to the pneumatic power means 42, whereby its piston rod 41 performs a stroke in outwards direction thereby actuating the knife 39 by the link 40, so that this knife is carried in under the knife 37 and thus performs a cutting movement. The piston rod 41 is subsequently retracted to the starting position shown in FIG. 7. The retracting movement can take place by air being supplied to the side of the piston facing the piston rod or in its case by means of a spring. The manner described for the control of a pneumatic power means is however well known in the art, and there is a lot of standard equipment available for providing such control. It is not necessary to provide a more detailed description of the components forming that part of the assembly.

The use of the apparatus for packing and sealing will now be described, reference being made to the steps 4–7 of the foregoing description of the method according to the invention and to FIGS. 4 to 6.

As is described in connection with step 4, the plastic blank 20 is inserted in the apparatus in the manner illustrated in FIG. 4, the containers 8 being placed in the recesses 23, the female parts being placed in the recesses 24 and the male parts 14 upon the pins 29 of the turned-up handle portion 26–30. The plastic blank 20 is thus folded in an upwards direction, so that the containers will be accessible.

According to step 5 the desired articles are now inserted into the containers. The articles are indicated with dashed and dotted lines 45. As the plastic blank has a plurality of of the finished packings several articles or sets of articles can be inserted simultaneously or in one question, which facilitates the work and makes possible a logical and simplified insertion procedure, even if automatic machines are not used.

According to FIG. 5 and step 6 the cardboard blank 17 is now inserted with its edge 18, forming the edges 16 of the respective pieces 2, close to the fold 13 of the plastic blank and with its openings 7 placed right in front of the recess 24.

According to FIG. 6 and step 7 the plastic blank is now locked by lowering the handle portion 26–30, whereby the flap portion of the rim flange of the plastic part is folded over the remaining part resting upon the plate 22 and the respective portion of the cardboard blank 17. At the end of the downward movement of the handle portion, the male parts 14 are inserted into the female parts 15 and are thereby carried through the openings 7 of the cardboard blank 17. Due to the fact that the recess 24 is somewhat shallower than the height for the male and female parts, a certain compression of the male and female parts takes place in the vertical direction, as is shown to some extend in FIG. 6 whereby their sides are slightly bent in an outwards direction, a snap-in action thereby occurring between the two parts. The parts will thus be locked to each other, but in spite thereof they can be separated as a result of the springy property of the sides, which can be moved slightly sideways. The locked packing blank is may extracted from the apparatus after the handle portion has been turned up, so that it is oriented in the position illustrated in FIGS. 4, 5.

The use of the cutting apparatus will now be described, reference being make to step 8 and FIG. 7.

After connection of the cutting apparatus to a source of compressed air, the packing blank is introduced into the opening 33 in an upright orientation, until its lower edge strikes against the plate 36 thereby pressing down the sensor organ 44. The knife 39 then performs a cutting stroke as described, and the blank is cut off along a dividing line 21 (FIG. 3). The knife 39 then pushes the cut-off part for a short distance under the knife 37, which means that the cut-off part is pushed off from the plate 36, which terminates somewhat inside the cutting edge of the knife 37. The space in the opening 33 thus will be free, and the blank falls down with the cut-off edge striking against the plate 36, whereby due to the actuation of the sensor organ 44, the knife 39 performs a new stroke, and a new cut-off part is obtained. In this manner the cutting operation is continued, until the whole blank is divided up in packings of the kind shown in FIG. 2.

The packing illustrated in FIG. 2 exhibits all the advantages of a blister pack mentioned in the preamble. Thus, it can be suspended by means of the opening 4 on a fork or on a simple bar. As a further advantage, the portion of the piece of cardboard 2 located outside of the plastic part 3 can be removed by means of the perforation rule 5. In such an instance it is assumed that at least the essential information on the removed portion is repeated on the remaining portion of the piece of cardboard, by way of example on the side located behind the preferably transparent lower portion 10. If the piece of cardboard 2 is so removed the packings will be suitable for storage in compartments. A label can be torn off from the removed portion by means of the perforation rule 6, on which label identification of the article inserted in the packing can be printed.

In this manner the packing serves the double function of a traditional suspendable blister pack and a packing, which at the same time is suitable for closed or open compartments completed with a label intended for the marking of the compartments. As has been mentioned earlier, a packing is obtained by means of the invention, which is locked in a secure manner but in spite thereof may be opened up, it subsequently being possible to reseal the same in an equally secure manner without any damage occurring to the parts of the packing.

The method and apparatus as described above very good solutions to the problems addressed. It is of special importance that the packing and the blanks for its manufacture, as well the production, packing of the articles and locking of the packs can be handled efficiently without the use of automatic machines, particularly when the packing run is small.

The invention can be modified within the scope of the following claims. Thus, the pack can differ greatly in appearance according to its adaptation to the articles to be packed, and it can also exhibit several containers for separately accommodating several articles which belong together.

Moreover, the blanks for the manufacture of the packings can have other shapes than the ones described. They shall of course be adapted to the finished packing, but for the rest they can be designed for an optional number of packings accommodated within the same blank. The formation of the parts, which together make up the assembly, can then take place in a different manner than the one shown in FIG. 3 in the form of a row. The apparatus as described above is of a relatively simple form, but it is within the scope of the invention to design it for partly or fully automatic operation.

What is claimed is:

1. A method for forming and fillng packs of articles, comprising the steps of :

forming a multiple unit in the shape of an elongate member having a plurality of corresponding receptacle parts and receptacle closing parts formed in one common piece, the receptacle parts being a row of recesses in the elongate member and the receptacle closing parts being foldable against the receptacle parts along a common folding line, the receptacle parts and closing parts being connected in registered alignment with one another and positioned side by side so as to form adjacent rows of same parts extending from end to end of the elongate member, the length of the elongate member being a multiple of the width of a finished pack;

pressing a row of male parts and a row of female parts out of the elongate member at corresponding positions such that upon folding the elongate member along the folding line the male parts are engaged in the female parts for holding the receptacle parts and closing parts together;

positively positioning each elongate member in an apparatus including location means of corresponding shape, for the purpose of filling the elongate member with articles, with all recesses of the receptacle parts facing upwards;

filling all the receptacle parts of the elongate member with articles in one operation;

prior to closing the receptacle parts, forming a sheet member of length corresponding to the elongate member and having openings located to correspond to the male parts and the female parts, and bringing the sheet member against the elongate member over one of the receptacle parts or closing parts;

closing all receptacle parts in the elongate member in one operation using the apparatus, by positioning the connected closing parts of the member over the recesses of the respective receptacle parts, when folding said closing parts to a position over the receptacle parts, the sheet member being held between the receptacle parts and the closing parts, the male parts and female parts engaging through the openings in the sheet member; and thereafter, dividing the elongate member into separate packs by laterally separating the elongate member and the sheet member along predetermined lines.

2. A method according to claim 1, wherein the sheet member is positioned to extend fully to the fold between the receptacle parts and the closing parts of the elongate member, after said folding operation, the sheet member being an intermediate part separating the row of receptacle parts and the attached row of closing parts.

* * * * *